United States Patent [19]

Vacchi

[11] 4,050,623

[45] Sept. 27, 1977

[54] CONTAINING BOX FOR VARIOUS PRODUCTS

[76] Inventor: Giorgio Vacchi, Via G. Marconi, 7, Bologna, Italy

[21] Appl. No.: 699,768

[22] Filed: June 25, 1976

[51] Int. Cl.[2] ..... B65D 5/16; B65D 5/32

[52] U.S. Cl. ..... 229/23 R; 206/626; 206/607

[58] Field of Search ..... 229/23 R, 51 R, 51 DB, 229/51 AS, 51 D

[56] References Cited

U.S. PATENT DOCUMENTS

| | | | |
|---|---|---|---|
| 1,221,911 | 4/1917 | Ruysdael | 229/51 AS |
| 2,713,451 | 7/1955 | Williamson et al. | 229/40 |
| 2,973,893 | 3/1961 | Carlin et al. | 229/51 AS X |
| 3,217,924 | 11/1965 | Chidsey, Jr. | 229/23 R X |
| 3,510,046 | 5/1970 | Reiner | 229/51 DB X |

FOREIGN PATENT DOCUMENTS

| | | | |
|---|---|---|---|
| 641,584 | 6/1962 | Italy | 229/51 AS |
| 603,543 | 6/1948 | United Kingdom | 229/51 D |

*Primary Examiner*—Davis T. Moorhead
*Attorney, Agent, or Firm*—Guido Modiano; Albert Josif

[57] ABSTRACT

A containing box for various products which is formed by a strip of sheet material folded so as to define a polygonal annular element and by two flaps sticked on ribs provided on the opposite sides of the annular element and closing the latter. The flaps are connected together by a panel which cover the zone of said annular element in which the opposite ends of the strip abut each other.

3 Claims, 12 Drawing Figures

CONTAINING BOX FOR VARIOUS PRODUCTS

BACKGROUND OF THE INVENTION

The present invention relates to a containing box for various products, particularly for contaning cigarettes, pastilles and similar products.

The new box is intended to be an alternative to the known rigid box which is gradually replacing the soft type packages for various products; this because of the better conservation of the products, of the less damaging in handling and easier possibility of mechanisation in the subsequent grouping or cartoning of the boxes, and finally because of a better presentation of the product itself.

SUMMARY OF THE INVENTION

Accordingly an object of the present invention is to provide a new rigid box of simple design, much cheaper than the conventional ones and which may be hermetically sealed.

Another object of the present invention is to provide a box having a plurality of compartments, which may be detached from one another thus reducing the size of the box.

These and other objects which will be more apparent hereinafter are attained by a containing box for various products a strip of sheet material folded so as to form a peripherical rectangular element with a top wall, a bottom wall and side walls connecting said top and bottom walls, said peripherical element defining two opposite open faces and peripherical ribs circumscribing said open faces and folded towards the inside of the peripherical element and perpendicularly thereto, a pair of flaps having the same shape of said rectangular element and whose margins are jointed to said ribs thus determining closing of the open faces of the element, wherein according to the improvement the opposite ends of said strip abut each other to form a slit transversally crossing the top wall of said element and said closing flaps have their borders laterally defining said top wall connected together by a panel covering said top wall, a tearing portion being further provided in said top wall and in said covering panel adjacent to said slit and defined by perforation lines.

BRIEF DESCRIPTION OF THE DRAWINGS

Further characteristics and advantages of the invention will be clearer and apparent from the detailed description of some embodiments, illustrated by way of nonlimiting examples in the accompanying drawings, in which.

DESCRIPTION OF PREFERRED EMBODIMENTS

Figure 1:
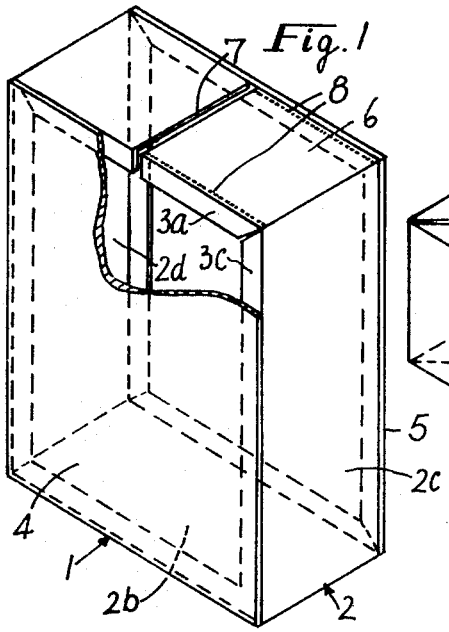
FIG. 1 shows a perspective view of a prismatic rectangular box according to the invention.
Figure 2:
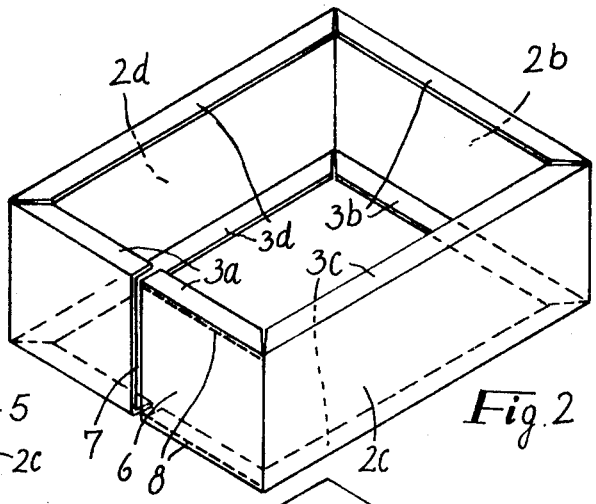
FIG. 2 shows a perspective view of the peripherical element of the box in FIG. 1.
Figure 3:
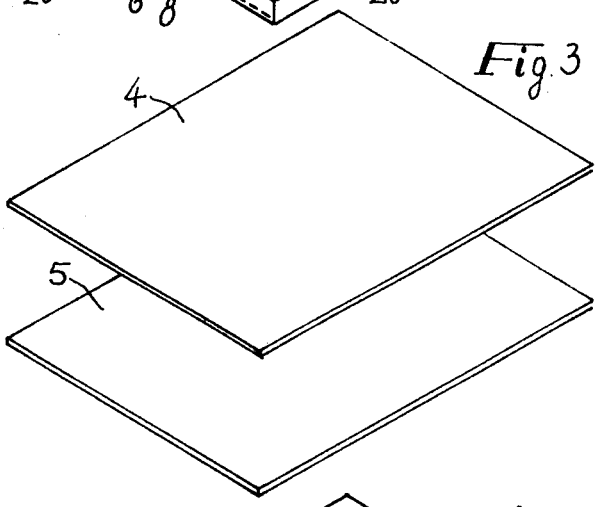
FIG. 3 shows a perspective view of the two flaps for closing the peripherical element of FIG. 2.

Referring to FIGS. 1, 2, 3, the box according to the present invention is generally indicated by 1 and includes a peripherical annular element 2 having a rectangular form and obtained from a strip of rigid or semi-rigid sheet material.

From the annular element 2 ribs 3*a*, 3*b*, 3*c*, 3*d* are bent towards the inside of the same element perpendicularly to the upper or top wall 2*a*, to the lower or bottom wall 2*b* and to the two side walls 2*c*, 2*d*. The ribs are obtained by folding at 90° the borders of the strip which is used to realise the annular element. In order to avoid overlapping of the ribs 3*a–d* at the angles defined by the walls 2*a–d*, triangular portions have been removed in such a way that the ribs 3*a–d* make a continuous frame which circumscribes the lateral open faces of the annular elements.

Rectangular flaps, cut from sheet material and indicated by 4,5, provide for closing the faces delimitated by the walls 2*a–d*. These flaps are applied on the ribs 3*a–d* by sticking, glueing or welding to the material with which the annular element of the box is manufactured.

The box can be opened by tearing up one of the two portions 6 of the top wall 2*a*, in proximity of a slit or junction line 7 which is defined by the adjacent extremities of the strip of the annular element 2. This junction line is placed in the middle of the top wall 2*a*.

Two perforated lines 8 extending along the lateral sides of the top portion 6 can be provided to facilitate the tearing up of the portion 6.

Figure 4:
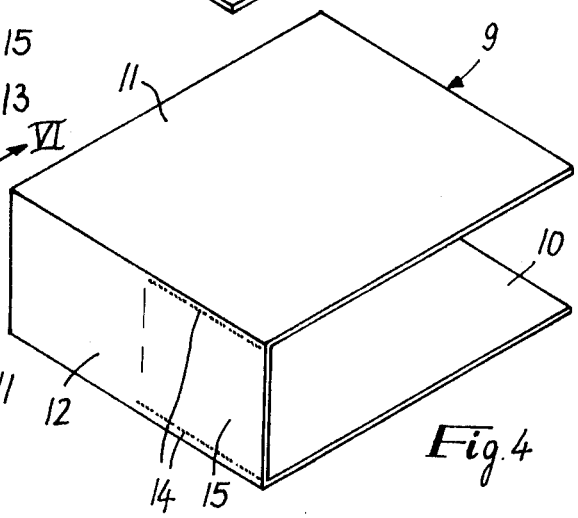
FIG. 4 shows a perspective view of another embodiment of the flaps for closing the peripherical element of FIG. 2.

In another embodiment of the invention the closing flaps of the side faces of the elment 2, instead of being made by two different elements, may be made by only one element of sheet material folded at U-shape, in such a way that it results similar to a stirrup 9 which is formed by two flaps 10, 11 jointed by an intermediate zone or panel 12, as it may be seen in FIG. 4.

Figure 5:
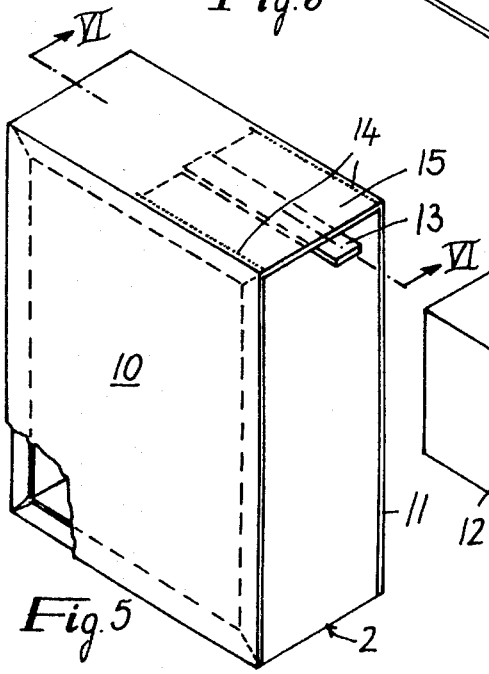
FIG. 5 shows a perspective view of a box provided with a tearing tongue.

The two flaps 10,11 of the stirrup 9 (see FIG. 5) can be welded, glued or sticked to the ribs 3*a–d* of the annular element 2, while the panel 12 will result detached from the below top wall 2*a* of the annular element 2.

Figure 6:
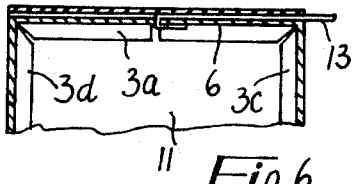
FIG. 6 shows a view according to the section line VI—VI of FIG. 5.

This structure allows also to apply a tearing tongue 13 arranged between the upper zone 12 and the portion 6 and then bent towards the inside of the box through the junction line 7 and sticked on the lower face of the portion 6 (see FIG. 6).

In the zone 12, because of the perforated lines 14, by pulling towards high the tongue 13, the upper portion 15 is lifted, detaching along the perforated lines 14, together with the lower portion 6, allowing the access to the inside of the box.

In a further embodiment of the invention (see FIG. 7) the strip of rigid or semi-rigid sheet material is folded in such a way to obtain two annular adjacent elements 16,17; these elements have rectangular perimeter, whose walls are indicated by 16*a–d* and 17*a–d*. The annular elements 16,17 have junction lines 18,19 in correspondence with the upper central folding line 20 which joints the adjacent walls 16*d* and 17*d*. These two annular elements 16,17 are closed by side flaps 21,22 which are welded, glued or sticked to the ribs 23*a–d*, 24*a–d* bent at 90° into the inside of the elements, from the walls 16*a–d*, 17*a–d*. In this way two separate containing spaces or compartments are obtained, which can be opened by lifting the upper portions 25,26 which are delimitated by perforation, as previously described in connection with portion 6 of FIG. 1.

The side flaps 21,22, along the central dividing line of the two compartments, may be provided with perforation lines 27, which allows to separate the two compartments when it is necessary. This subdivision of the box, which may be further facilitated by a perforation along the folding line 20, results particularly useful in order to reduce the overall dimensions of the box, removing the empty compartment of the package.

Figure 8:
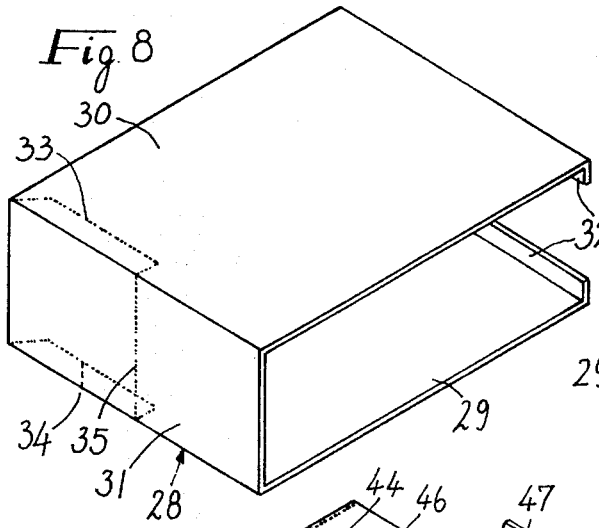
FIG. 8 shows a perspective view of another embodiment of the flaps for closing the peripherical element of FIG. 2.
Figure 9:
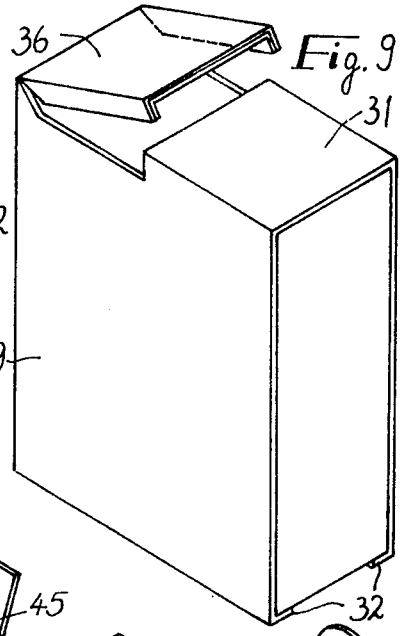
FIG. 9 shows a perspective view of a box provided with the closing flaps of FIG. 8.

According to a further embodiment of the invention, as illustrated in FIG. 8, a stirrup or U-shaped element 28, similar to that previously indicated in FIG. 4, is foreseen with closing flaps 29,30 presenting bottom marginal portions or borders 32 opposite to those connected by the intermediate zone 31. When applying the U shaped element for closing the package to a peripherical annular element, like that indicated at 2 in FIG. 2, these marginal borders 32 are welded, glued or sticked to the bottom wall 2*b*. The finished box (FIG. 9), thus resulting particularly stiff because of the borders 32 sticked to the bottom, may be opened providing on th flaps 29,30 the perforation lines 33,34 which extend on he flaps 29,30 along the ribs 3*a* and a transversal perforation line 35 which extends on the zone 31 along the junction line 7, thus allowing to lift a portion 36 of the top of the box itself, as shown in FIG. 9.

Figure 10:
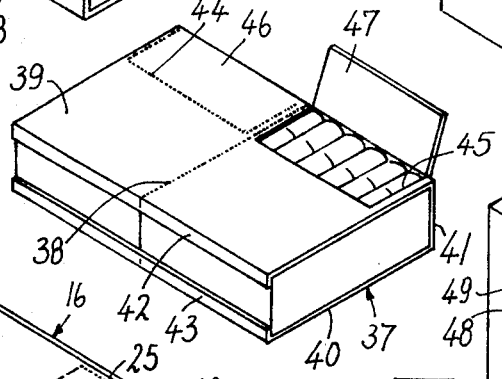
FIGS. 10, 11, 12 shows perspective views of boxes having two compartments and different types of openings.
Figure 7:
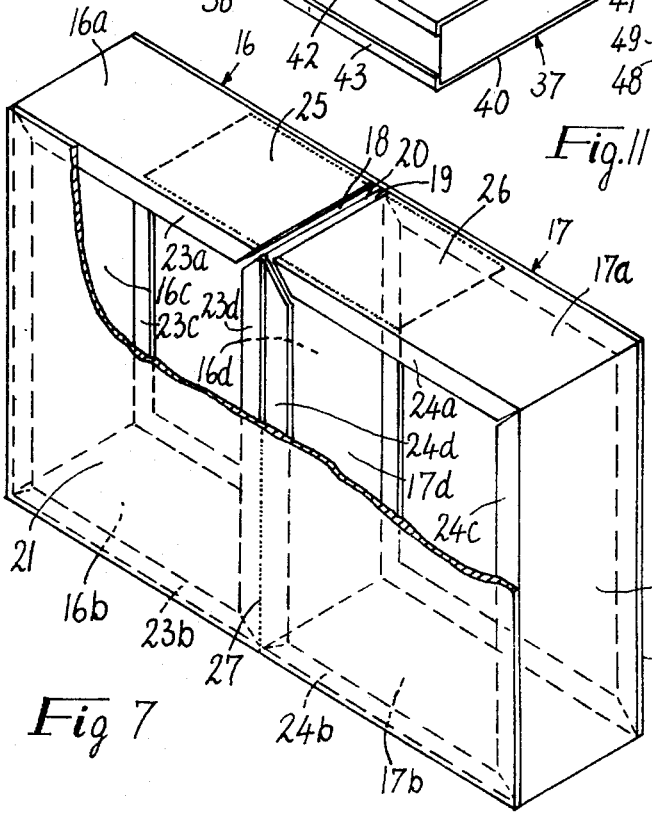
FIG. 7 shows a perspective view of a box with two compartments.

Obviously it is also possible to use a U shaped element 17 as indicated in FIG. 10, with a central perforation line 38 to close two adjacent annular elements like those indicated by 16,17 in FIG. 7.

Figure 11:
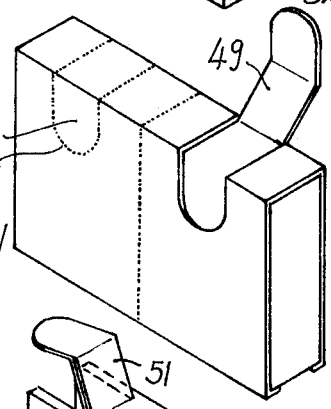
Figure 12:
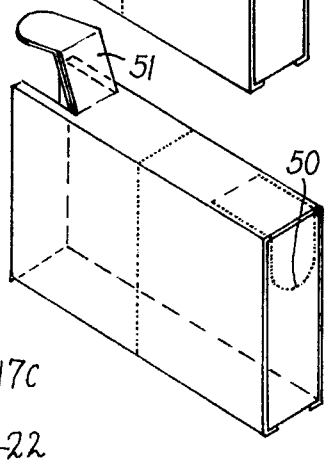

For easier operation the central perforation line 38 can be further extended from the central line of the flaps 39,40 of the element 37 also through the top zone 41 which joins the side flaps 39,40 and the marginal borders 42,43 (FIGS. 10, 11, 12). In order to get to the inside of the two compartments in which the box is divided, proper perforation lines 44,45 are provided on the flap 39 which define opening tongues 46, 47: these can be rectangular (FIG. 10) or of any other shape depending on the product to be packed.

In the embodiment of FIG. 11, semicircular perforation lines 48 are provided on one flap which continue also on the top zone. In this way a central tongue 49 may be lifted in each compartment of the box.

In some cases it may be preferably to provide semicircular perforations 50 (see FIG. 12) on the upper part of each side wall 16*c*, 17*c* of the box, which prosecute on part of the top walls 16*a*, 17*a* through the top zone 41 of the element 37. The tongues 51 may be opened one towards the other.

The invention, as shown, gets perfectly to the purposes; in fact a sufficiently rigid or crush-proof box can be realised with a considerable saving of packaging materials. It offers enough warranties of stiffness because of its structure and of the presence of the ribs 3*a–d* which acts as a reinforcing frame.

The possibility of obtaining multiple compartments detachable one from the other appears very useful, since while it allows the economic packaging of a large quantity of product in one multiple container, it enables either at the selling point or at the consumer, to sell or utilize a submultiple of the product without spoiling the packaging of the remaining.

It is also advantageous that the box as described, as an alternative in the packaing process, instead of being filled with product, can be formed on the product itself by wrapping firstly around the product the peripherical annular element and subsequently by applying the side closing flaps. In accomplishment of the invention, any material may be used. For instance: any type of cardboard, paper, natural, printed, painted or plastified or aluminium coated, as well as sheets of any plastic material. Side flaps can be sticked or sealed on the ribs of the peripherical element, also by thermowelding processes.

Finally it is important to point out that the concept of the invention can be applied to multiple rectangular boxes and to boxes of any prismatic form as for example triangular, trapezoidal, circular and polygonal.

I claim:

1. A containing box for various products comprising a strip of sheet material folded so as to form a peripherical rectangular element with a top wall, a bottom wall and side walls connecting said top and bottom walls, said peripherical element defining two opposite open faces and peripherical ribs circumscribing said open faces and folded towards the inside of the peripherical element and perpendicularly thereto, a pair of flaps having the same shape of said rectangular element and whose margins are jointed to said ribs thus determining closing of the open faces of the element, wherein according to the improvement the opposite ends of said strip abut each other to form a slit transversally crossing the top wall of said element and said closing flaps have their borders laterally defining said top wall connected together by a panel covering said top wall, a tearing portion being further provided in said top wall and in said covering panel adjacent to said slit and defined by perforation lines.

2. A containing box as claimed in claim 1 wherein the strip is folded so as to define two adjacent walls perpendicularly extending from the bottom wall towards the inside of said peripherical element and connected together at their upper ends according to a folding line, the opposite ends of said strip being adjacent to said folding line and said peripherical element being closed by side flaps to define two separate compartments, perforation lines being provided extending on said side flaps according to said adjacent walls and on the covering panel according to a line coincident with said folding line, to consent division of the box in two.

3. A containing box as claimed in claim 1 wherein said tearing portion is defined by perforation lines formed in the side flaps in coincidence with the outline of the ribs of the top wall and in the covering panel in coincidence with the slit.

* * * * *